US010598122B2

(12) United States Patent
Iga et al.

(10) Patent No.: US 10,598,122 B2
(45) Date of Patent: Mar. 24, 2020

(54) CYLINDER HEAD COOLING STRUCTURE

(71) Applicant: KUBOTA Corporation, Osaka-shi, Osaka (JP)

(72) Inventors: Michisuke Iga, Sakai (JP); Kiyoharu Kimoto, Sakai (JP)

(73) Assignee: KUBOTA Corporation, Osaka-Shi, Osaka (JP)

( * ) Notice: Subject to any disclaimer, the term of this patent is extended or adjusted under 35 U.S.C. 154(b) by 0 days.

(21) Appl. No.: 15/366,357

(22) Filed: Dec. 1, 2016

(65) Prior Publication Data

US 2017/0184051 A1 Jun. 29, 2017

(30) Foreign Application Priority Data

Dec. 28, 2015 (JP) ..... 2015-256790

(51) Int. Cl.
*F01L 1/14* (2006.01)
*F02F 1/40* (2006.01)
(Continued)

(52) U.S. Cl.
CPC ..... *F02F 1/40* (2013.01); *F01L 1/047* (2013.01); *F01L 1/146* (2013.01); *F01L 1/18* (2013.01);
(Continued)

(58) Field of Classification Search
CPC . F01L 1/146; F01L 1/181; F01L 1/047; F01L 1/245; F01L 13/0031; F01L 2810/02; F01L 1/18; F01L 1/26; F01L 1/34; F01L 2001/0476; F01L 2001/054; F01L 2001/34423; F01L 2250/06; F01L 9/025; F01L 13/0036; F01L 1/14; F01L 1/24;
(Continued)

(56) References Cited

U.S. PATENT DOCUMENTS 1,741,230 A * 12/1929 Goodwin ..... F01P 3/14 123/41.41
1,864,314 A * 6/1932 Morrill ..... F01M 9/101 184/6.9
(Continued)

FOREIGN PATENT DOCUMENTS

DE 102007054992 A1 * 5/2009 ..... F01L 1/047
JP S54056042 A 5/1979
(Continued)

OTHER PUBLICATIONS

DE 102007054992 Translation.*
Office Action dated Sep. 10, 2018 in JP Application No. 2015256790.

*Primary Examiner* — George C Jin
*Assistant Examiner* — Teuta B Holbrook
(74) *Attorney, Agent, or Firm* — Panitch Schwarze Belisario & Nadel LLP

(57) ABSTRACT

In a cylinder head cooling structure of engine E including a camshaft 15 rotated by a crankshaft 2, a push rod, and an actuatable rocker arm, an injection hole 46 for injecting oil pressurized by an oil pump 44 is formed in a shaft portion 43 between an exhaust cam 36 on the camshaft 15 and a journal 15*j* at its rear end, and the oil injected the injection hole 46 is allowed to enter a rear cylinder head cover 7 through a pushrod chamber in which the push rod is disposed.

9 Claims, 11 Drawing Sheets

(51) Int. Cl.
*F02F 1/28* (2006.01)
*F01L 1/047* (2006.01)
*F01L 1/18* (2006.01)

(52) U.S. Cl.
CPC ..... *F02F 1/28* (2013.01); *F01L 1/181* (2013.01); *F01L 2810/02* (2013.01)

(58) Field of Classification Search
CPC ..... F01L 1/42; F01L 1/46; F01L 2001/256; F01M 9/102; F01M 9/107; F01M 9/105; F16C 2360/18; F16C 9/00
USPC ..... 123/196 R, 41.42, 90.33–90.36
See application file for complete search history.

(56) References Cited

U.S. PATENT DOCUMENTS 2,676,579 A * 4/1954 Gerner ..... F01L 1/2422 123/90.57
3,023,844 A * 3/1962 Kolbe ..... F01M 1/06 184/6.9
3,033,314 A * 5/1962 Wetterhahn ..... F01M 1/06 184/6.9
3,664,312 A * 5/1972 Miller, Jr. ..... F01L 1/22 123/90.19
3,757,749 A * 9/1973 Hatz ..... F01L 1/14 123/90.2
4,100,909 A * 7/1978 Nakano ..... F01M 1/02 123/196 AB
4,582,029 A * 4/1986 Masuda ..... F01L 1/12 123/90.16
4,615,310 A * 10/1986 Umeha ..... F16H 57/043 123/90.33
4,651,704 A * 3/1987 Sekiguchi ..... F01L 1/047 123/572
4,739,675 A * 4/1988 Connell ..... F01L 1/14 123/90.48
4,754,606 A * 7/1988 Nam ..... F02B 73/00 60/616
4,896,634 A * 1/1990 Kronich ..... F01M 1/02 123/196 W
5,186,129 A * 2/1993 Magnan ..... F01L 1/047 123/90.33
5,273,007 A * 12/1993 Ampferer ..... F01L 1/047 123/90.34
5,309,878 A * 5/1994 Kandler ..... F01M 1/02 123/196 M
5,450,665 A * 9/1995 Madono ..... F01L 1/047 164/132
5,492,085 A * 2/1996 Tiller ..... F01L 1/146 123/90.35
6,173,689 B1 * 1/2001 Tanaka ..... F01L 1/02 123/90.33
6,631,701 B2 * 10/2003 Seader ..... F01L 1/047 123/196 R
6,782,855 B1 * 8/2004 Albertson ..... F01L 1/146 123/198 F
7,854,215 B2 * 12/2010 Rozario ..... F01L 1/146 123/90.39
7,861,680 B2 * 1/2011 Diggs ..... F01L 1/14 123/90.39
2002/0117020 A1 8/2002 Novak
2004/0011314 A1 * 1/2004 Seader ..... F01M 1/06 123/90.34
2006/0169236 A1 * 8/2006 Karbstein ..... F01L 1/146 123/90.55
2008/0041324 A1 * 2/2008 Matsushima ..... F01M 13/022 123/41.21
2008/0264365 A1 * 10/2008 Kohrs ..... F01L 1/352 123/90.17
2011/0265745 A1 * 11/2011 Burgess ..... F01L 1/024 123/54.4
2013/0239916 A1 * 9/2013 Strusch ..... F01L 1/181 123/90.1

FOREIGN PATENT DOCUMENTS

JP 61025906 A * 2/1986 ..... F01M 5/002
JP S62083558 A 4/1987
JP 11343826 A * 12/1999
JP 2008045509 A 2/2008
JP 2009185748 A 8/2009

* cited by examiner

CYLINDER HEAD COOLING STRUCTURE

BACKGROUND OF THE INVENTION (1) Field of the Invention

The present invention relates to a cylinder head cooling structure of an overhead valve engine, such as an industrial engine.

(2) Description of Related Art

For example, an air-cooled V-type engine described below is known as an overhead valve industrial engine.

In such an air-cooled V-type engine, an oil inlet is provided in the bottom of a pushrod chamber in a downstream cylinder unit located downstream in a cam rotation direction relative to a rib, and the oil inlet faces the cam and communicates with the inside of a head cover of the downstream cylinder unit through the pushrod chamber of the downstream cylinder unit.

As such, oil mist in a crankcase condenses on the ceiling of the crankcase, and condensed oil drops from the rib, splashes over the oil inlet by the cam, and is supplied to the head cover of the downstream cylinder unit by blow-by gas rising through the pushrod chamber.

That is, a conventional overhead valve (OHV) engine is configured such that engine oil is supplied into a cylinder head through the pushrod chamber by oil mist produced by stirring oil as a crankshaft etc. is rotated in the crankcase and by natural diffusion of the oil mist due to rotation of a camshaft.

However, it has been found that cooling capacity tends to be insufficient depending on various conditions, such as engine structure, usage status and use environment, for example, in such a manner that an engine arrangement may cause uneven cooling or the engine is continuously operated in a high temperature location. One of eminent failures is that a stem seal of a valve on the exhaust side (i.e., an exhaust valve) under severe temperature conditions is susceptible to degradation by heat.

SUMMARY OF THE INVENTION

An object of the present invention is to provide a cylinder head cooling structure whose cooling efficiency is improved by oil cooling in order to prevent the above failure due to heat by increasing oil supply to a cylinder head portion per unit time without incurring any additional pumping route from an oil pump by reviewing the existing structure.

The present invention is directed to a cylinder head cooling structure of an engine that includes a camshaft rotated by a crankshaft, a push rod driven inwardly and outwardly by the camshaft, and a rocker arm swung like a balance in conjunction with inward and outward movement of the push rod, wherein an injection hole for injecting oil pressurized by an pump is formed in a shaft portion between cams on the camshaft or between a cam and a journal, and the oil injected from the injection hole is allowed to reach a pushrod chamber in which the push rod is disposed.

According to the present invention, oil mist produced by injection of oil pressurized by the oil pump from the injection hole provided in the shaft portion of the camshaft as well as oil mist in a crankcase is introduced into the pushrod chamber, so that oil supply into the cylinder head per unit time can be significantly increased as compared to prior art structures. Additionally, since arrangement for that purpose only needs to be provided with the injection hole for injecting oil from the oil pump in the shaft portion of the camshaft, large-scale modifications, such as providing an additional oil path in a cylinder block, are not required.

As a result, a cylinder head cooling structure can be provided whose cooling efficiency is improved by oil cooling in order to prevent the failure due to heat, such that the stem seal of an exhaust valve is susceptible to degradation by heat, by increasing the oil supply to a cylinder head portion per unit time without incurring any additional pumping route from an oil pump by reviewing the existing structure.

DETAILED DESCRIPTION OF PREFERRED EMBODIMENTS

Figure 1:
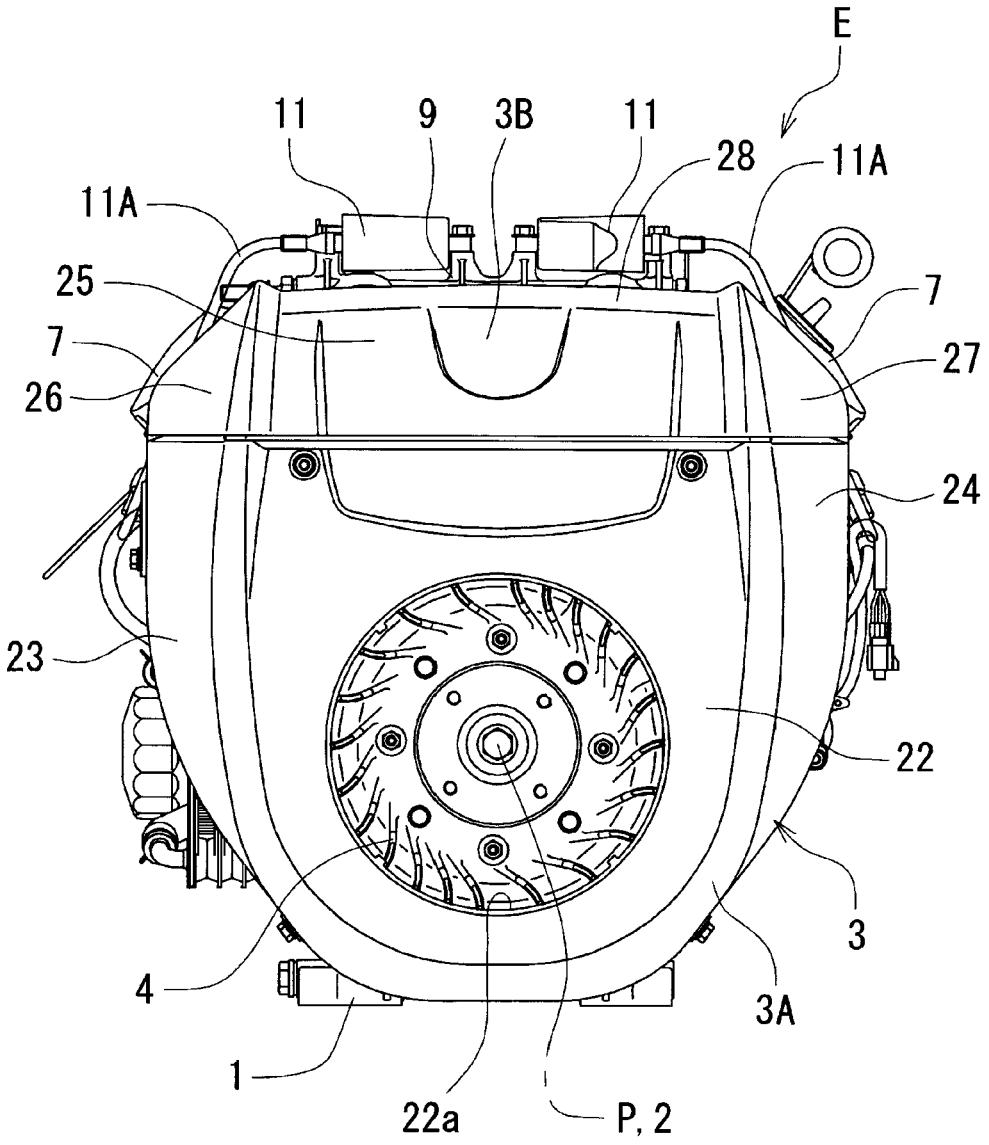
FIG. 1 is a front view of an air-cooled V-type engine according to the present invention.
Figure 2:
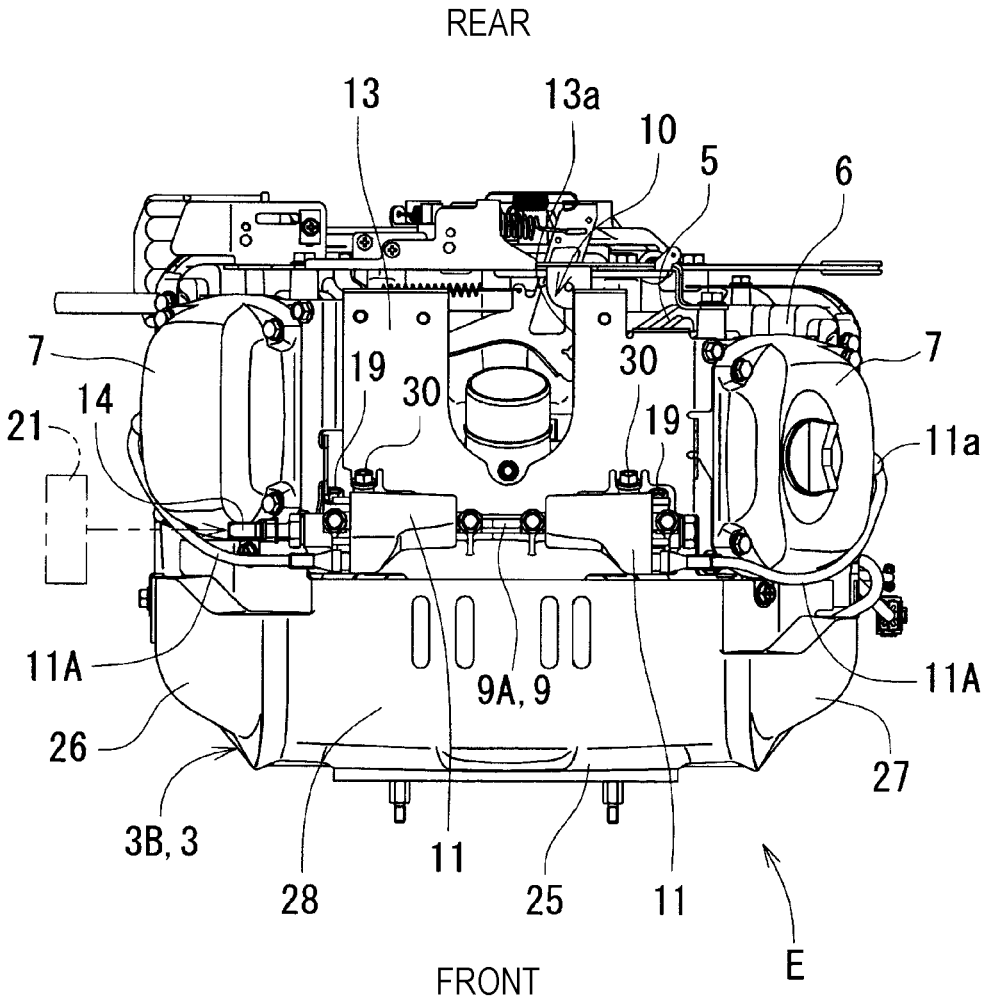
FIG. 2 is a plan view of the engine illustrated in FIG. 1.
Figure 3:
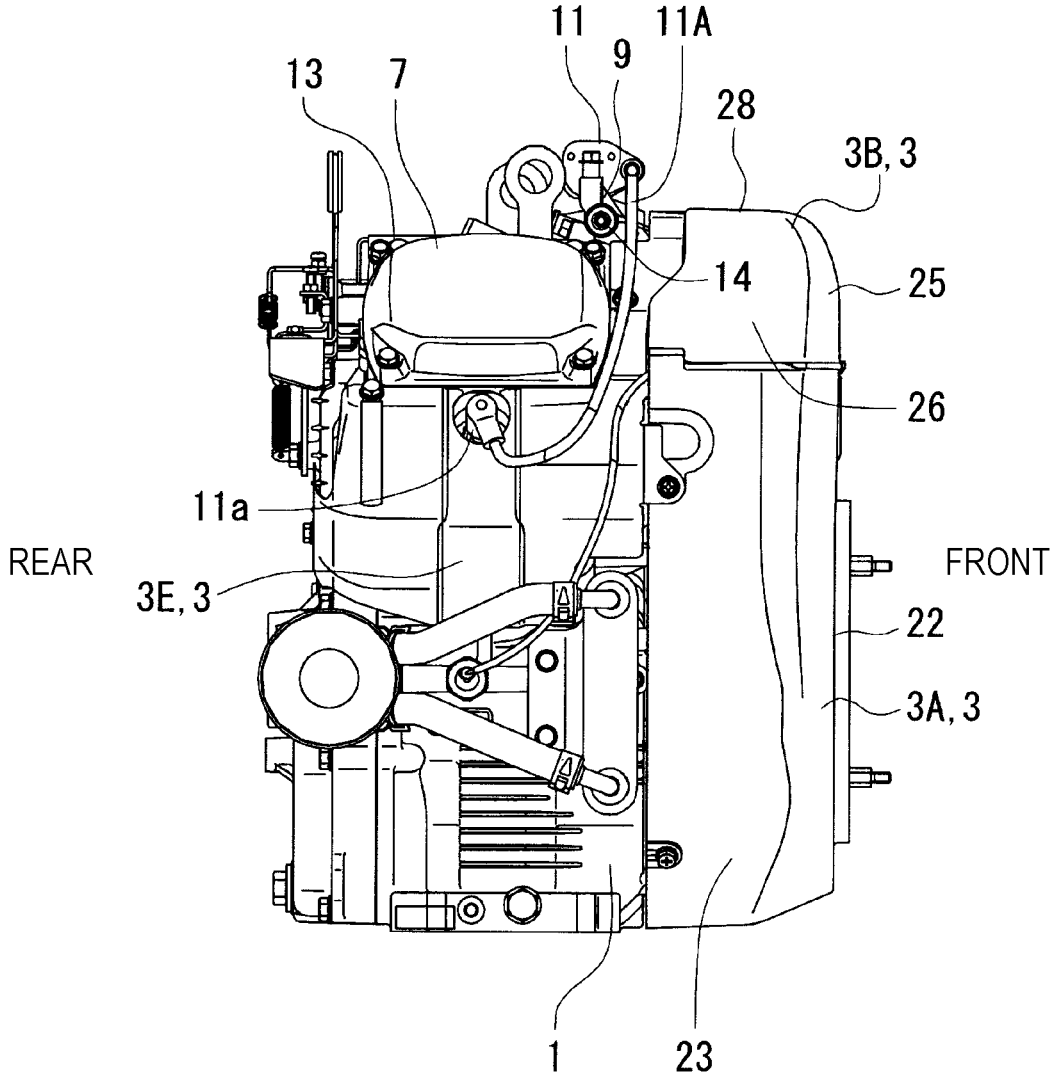
FIG. 3 is a left side view of the engine illustrated in FIG. 1.

Preferred embodiments of a cylinder head cooling structure according to the present invention, which is applied to an air-cooled V-type industrial engine, will now be described with reference to the drawings.

As illustrated in FIGS. 1 through 8, an air-cooled V-type engine E according to the present invention includes a crankcase 1, a crankshaft 2, a fan case 3, and an engine cooling fan 4. Assuming that the direction in which the crankshaft 2 is mounted is a front-rear direction, one end in the front-rear direction is the front and another end in the front-rear direction is the rear, the fan case 3 is provided on the front portion of the crankcase 1, and the engine cooling fan 4 mounted on the front end (i.e., an example of one end) of the crankshaft 2 is housed in the fan case 3.

There are provided a pair (i.e., an example of plurality) of cylinders 5, 5 projecting to form a V-shape from the crankcase 1 to the upper right and left when viewed in the direction of an axial center P of the crankshaft 2, cylinder beads 6, 6 attached to the upper ends (i.e., distal ends) of the cylinders 5, 5, and cylinder head covers 7, 7 attached to the distal ends of the cylinder heads 6, 6. As illustrated in FIGS. 1 through 4, the fan case 3 is configured in size and shape to cover the cylinders 5, 5 and the cylinder heads 6, 6, and thus the engine cooling fan 4 can easily cool the engine in an active manner. While the crankcase 1 and the cylinders 5, 5 are integrally molded to form a cylinder block (no reference number), they may be configured separately.

Figure 5:
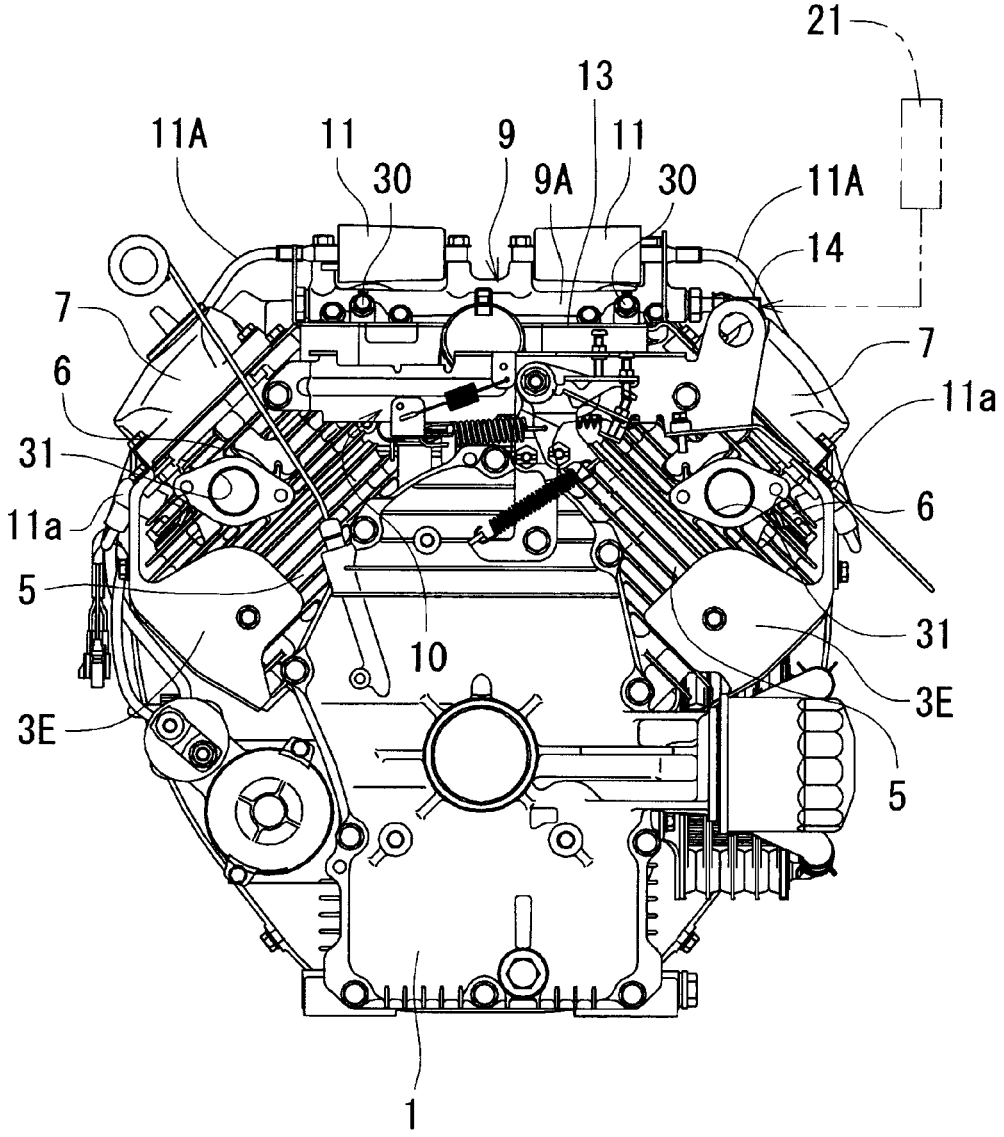
FIG. 5 is a rear view of the engine illustrated in FIG. 1.
Figure 6:
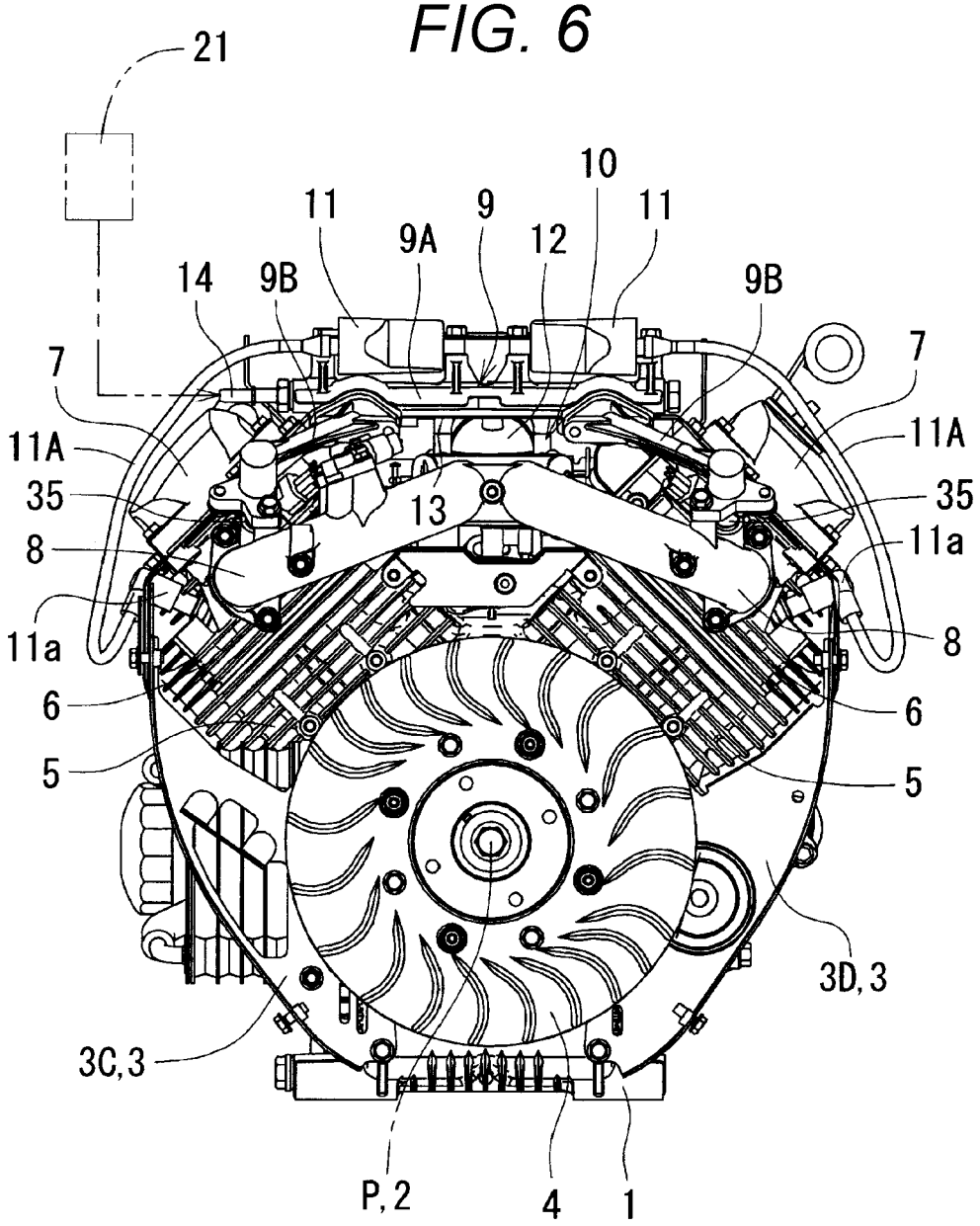
FIG. 6 is a front view of the engine illustrated in FIG. 1 with its fan case removed.
Figure 7:
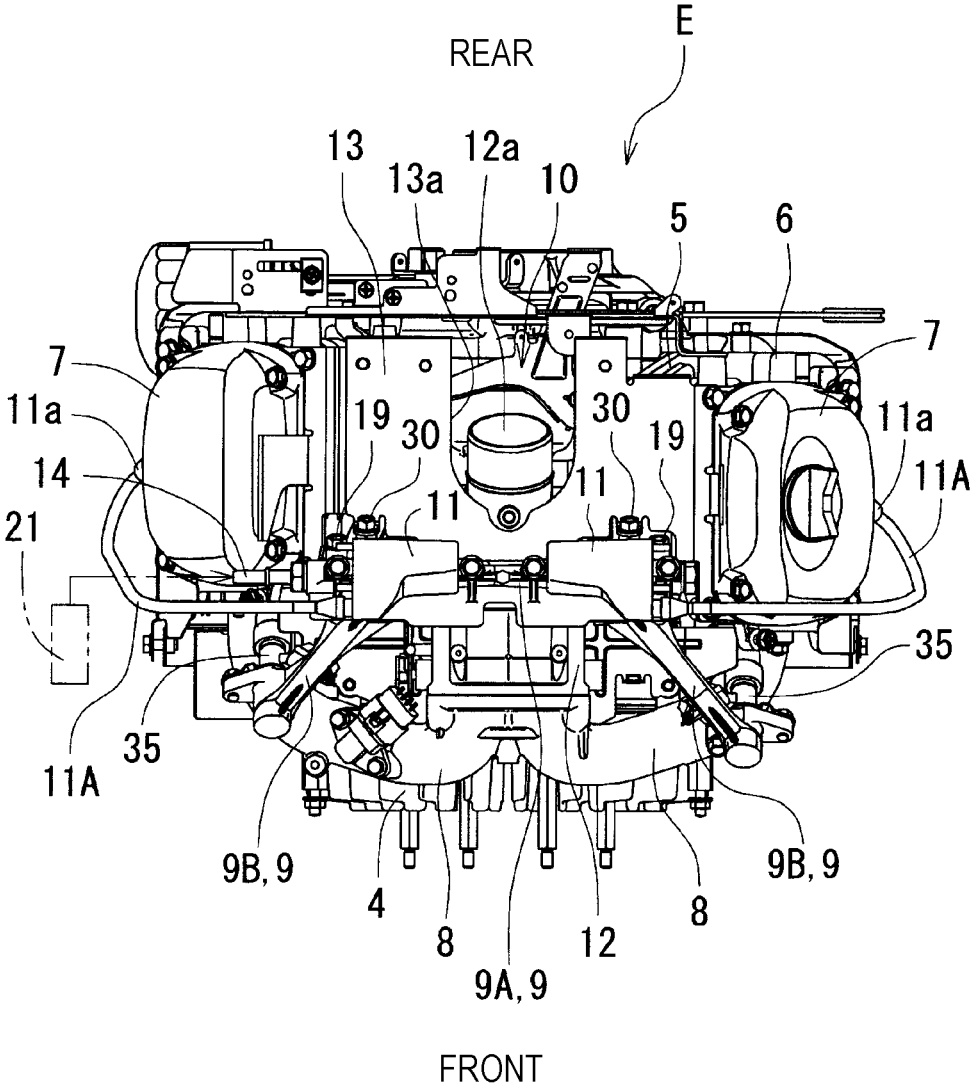
FIG. 7 is a plan view of the engine illustrated in FIG. 1 with its fan case removed.

Thus, the air-cooled V-type engine E includes the crankcase 1, the engine cooling fan 4 mounted on one end of the crankshaft 2, the fan case 3 for housing the engine cooling fan 4, the plurality of cylinders 5, 5 projecting to form a V-shape from the crankcase 1 when viewed in the direction of the axial center P of the crankshaft 2, and the cylinder heads 6, 6 attached to the distal ends of the cylinders 5, 5, respectively. In FIG. 5, reference number 31 is directed to an exhaust outlet of the cylinder head 6.

As illustrated in FIGS. 5 through 8, a throttle body 12 is disposed in an included angle place 10 that is a location (or space) between the left cylinder 5 and its cylinder head 6 and the right cylinder 5 and its cylinder head 6. Left and right intake manifolds 8, 8, extending from the throttle body 12 to intake air inlets (not shown) of the cylinder heads 6, 6 are mounted, each being inclined with its distal end lowered. The intake manifolds 8, 8 are located on the front side where the engine cooling fan 4 is located, and exhaust outlets 31, 31 of the cylinder heads 6, 6 are provided on the rear side.

A distributor 9, which receives fuel supplied from a fuel supply device 21 through an inlet pipe 14 and distributes the fuel to the intake manifolds 8, 8, is positioned across the included angle place 10 located between the cylinders arranged in a V-shape. A pair of legs 9B, 9B, extending from both sides of a distributor body 9A in the distributor 9, are coupled to the intake manifolds 8 near the cylinder heads in a communication connection state through fuel injection devices 35 such as an injector. Thus, it is configured such that the fuel supplied from the fuel supply device 21 is injected from the fuel injection devices 3 through the distributor 9, and the injected fuel is supplied to the cylinder heads 6, 6 through the intake manifolds 8, 8.

An air cleaner mounting plate (an example of an air cleaner mounting structure) 13 is provided immediately above the throttle body 12, the air cleaner mounting plate 13 being a doubly supported structure that is bolted to the left and right cylinder heads 6, 6, spanning the included angle place 10. The middle portion of the an cleaner mounting plate 13 is largely cut away from rear to front, and a suction port 12*a* of the throttle body 12 is arranged to face a cut-away portion 13*a* with the suction port 12*a* sloping upwardly and rearwardly. The air cleaner mounting plate 13 is a plate for supporting and fixing an air cleaner (not shown).

Figure 8:
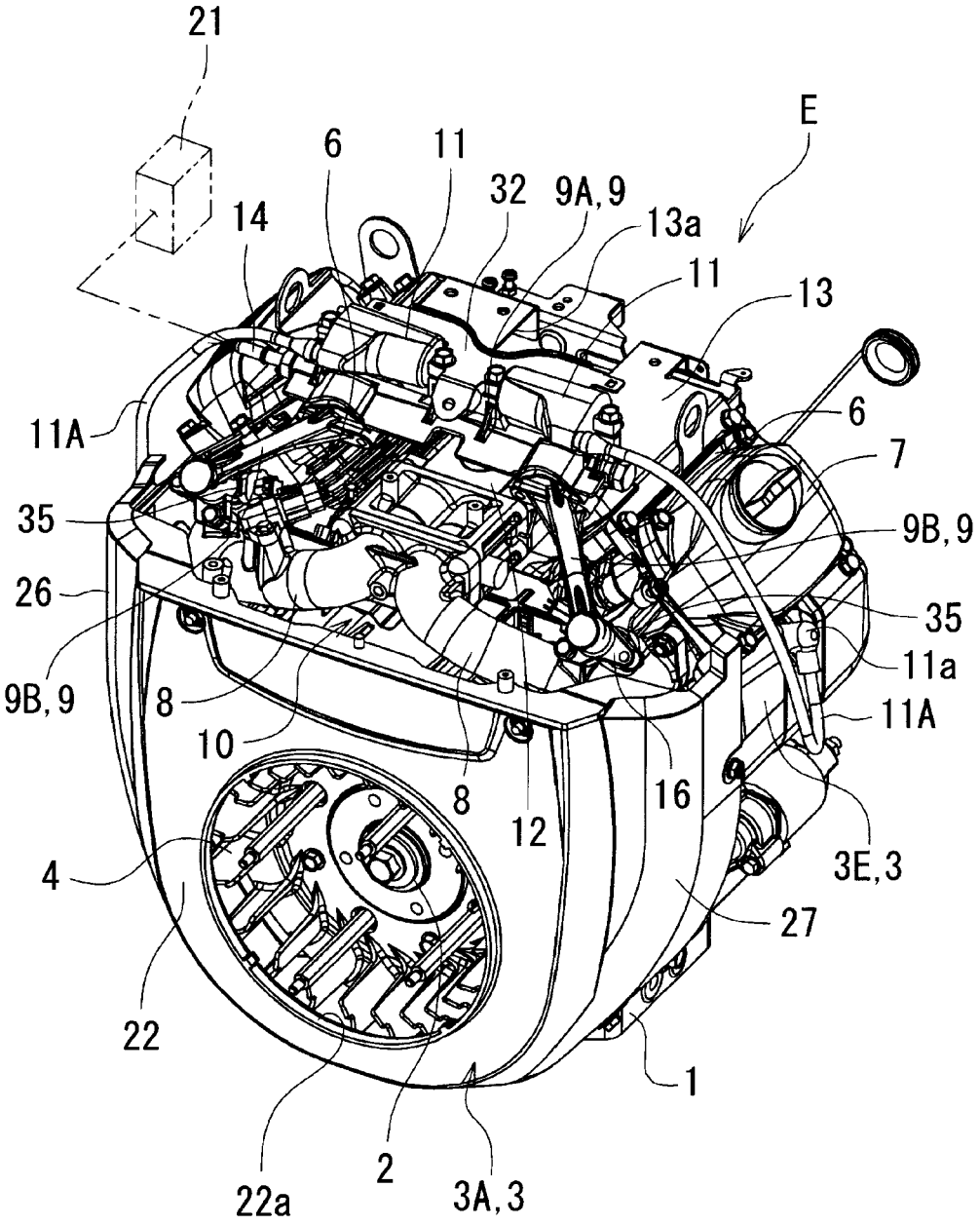
FIG. 8 is a perspective view from the upper right of the engine illustrated in FIG. 1.

The distributor 9 is horizontally disposed on the air cleaner mounting plate 13, being supported by the air cleaner mounting plate 13. The distributor 9 is provided thereon with ignition coils 11, 11 for the pair of cylinders 5, 5, the ignition coils 11, 11 being arranged horizontally (i.e., in a direction intersecting the axial center P), reversed to each other. In FIG. 8, a mounting plate 32 is attached to the distributor 9, exhibiting a substantially T-shape in a plan view so as to avoid interfering with the ignition coil 11, 11.

That is, the distributor 9, which distributes the supplied fuel to intake manifolds 8, 8 of the cylinders 5, 5 and more specifically to the fuel injection devices 35, 35 mounted on the intake manifolds 8, is positioned across the included angle place 10 located between the cylinders 5, 5 arranged in a V-shape. The ignition coils 11, 11 for the plurality of cylinders 5, 5 are mounted on the distributor 9. The distributor 9 is a functional component that distributes fuel, (such as pressurized fuel), supplied from the fuel supply device 21 including a fuel pump for discharging pressurized fuel to the fuel injection devices 35, 35.

As illustrated in FIGS. 1 through 4 and FIG. 8, the fan case 3 is configured to have a case body 3A for covering a large part of the engine cooling fan 4 and the left and right cylinders 5, 5 from the direction of the axial center P, an upper case 3B for covering the left and right cylinder heads 6, 6 and cylinder head covers 7, 7 from the direction of the axial center P, a left rear wall 3C (see FIG. 6), a right rear wall 3D (see FIG. 6), and a guide wall 3E disposed on the side of the cylinder head 6.

The case body 3A includes a front wall 22, and a left side wall 23 and a right side wall 24 contiguous with the front wall 22, and the front wall 22 is provided with a large suction port 22*a*. The upper case 3B has a front wall 25, a left wall 26, a right wall 27, and a top wall 28.

After being sucked from the suction port 22*a* of the case body 3A by rotation of the centrifugal engine cooling fan 4, air is strongly blown from the engine cooling fan 4 in the distal direction of the axial center P, as a cooling air. The cooling air blown is directed to the left and right cylinders 5, 5 and the cylinder heads 6, 6 through the fan case 3 comprised of the case body 3A and the upper case 3B and cools the cylinders 5, 5 and the cylinder heads 6, 6. The cooling air is also directed to the included, angle, place 10 between the left and right cylinders 5, 5, and thus the throttle body 12, the distributor 9, the ignition coil 11, etc. can also be air-cooled.

According to such a configuration, the throttle body 12, the air cleaner mounting plate 13, the distributor 9, and the ignition coil 11 are three-dimensionally arranged in this order from the bottom to the top in the included angle place 10.

A high tension code (output line) 11A of the ignition coil 11 extends bypassing the cylinder head cover 7 in front thereof, and a plug cap 11*a* attached to an end of the code is fitted to a spark plug 29 (see FIG. 9) located on the right and left sides of the cylinder head 6.

Figure 4:
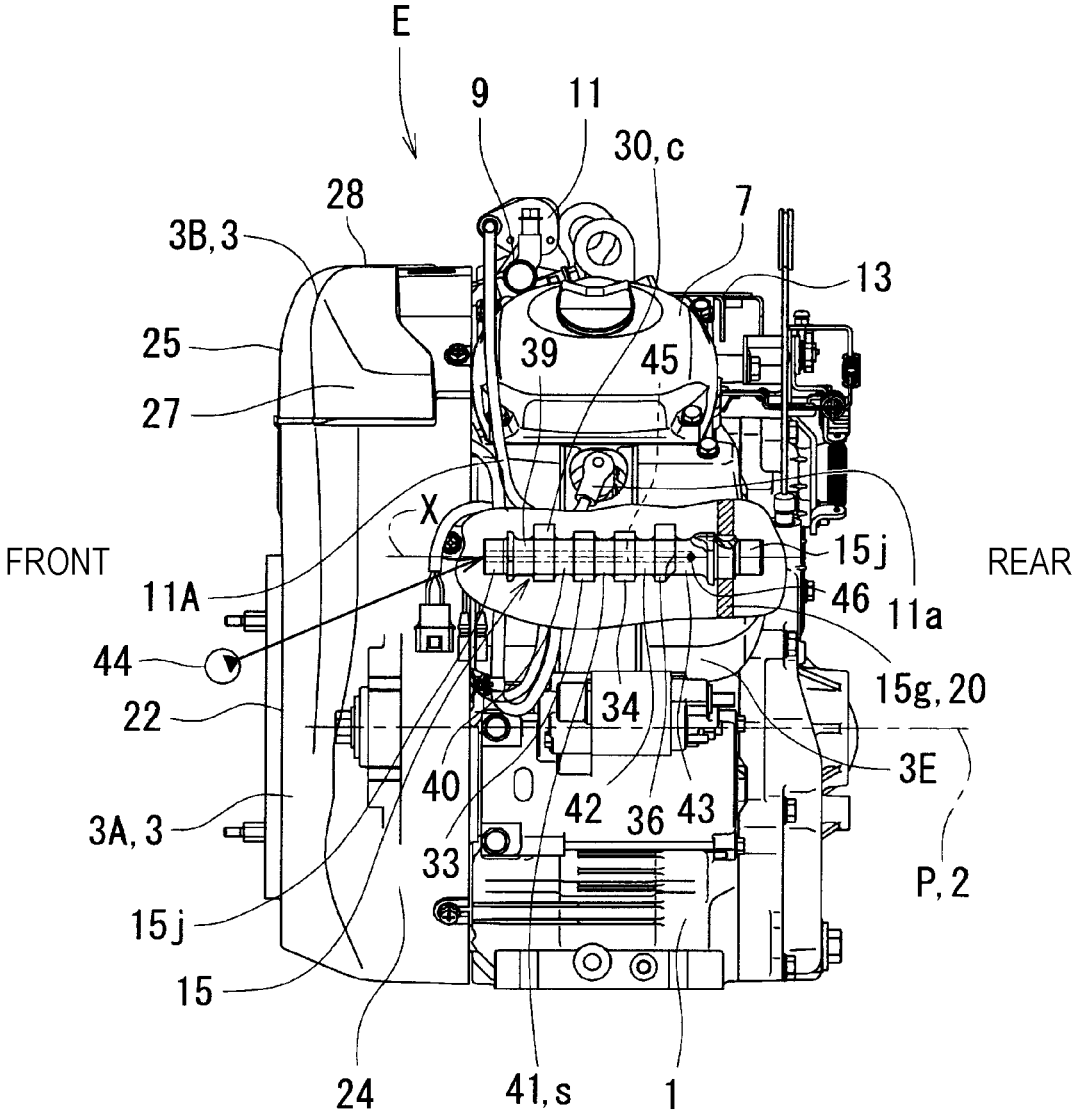
FIG. 4 is a partially transparent right side view of a portion perspective of the engine illustrated in FIG. 1.
Figure 9:
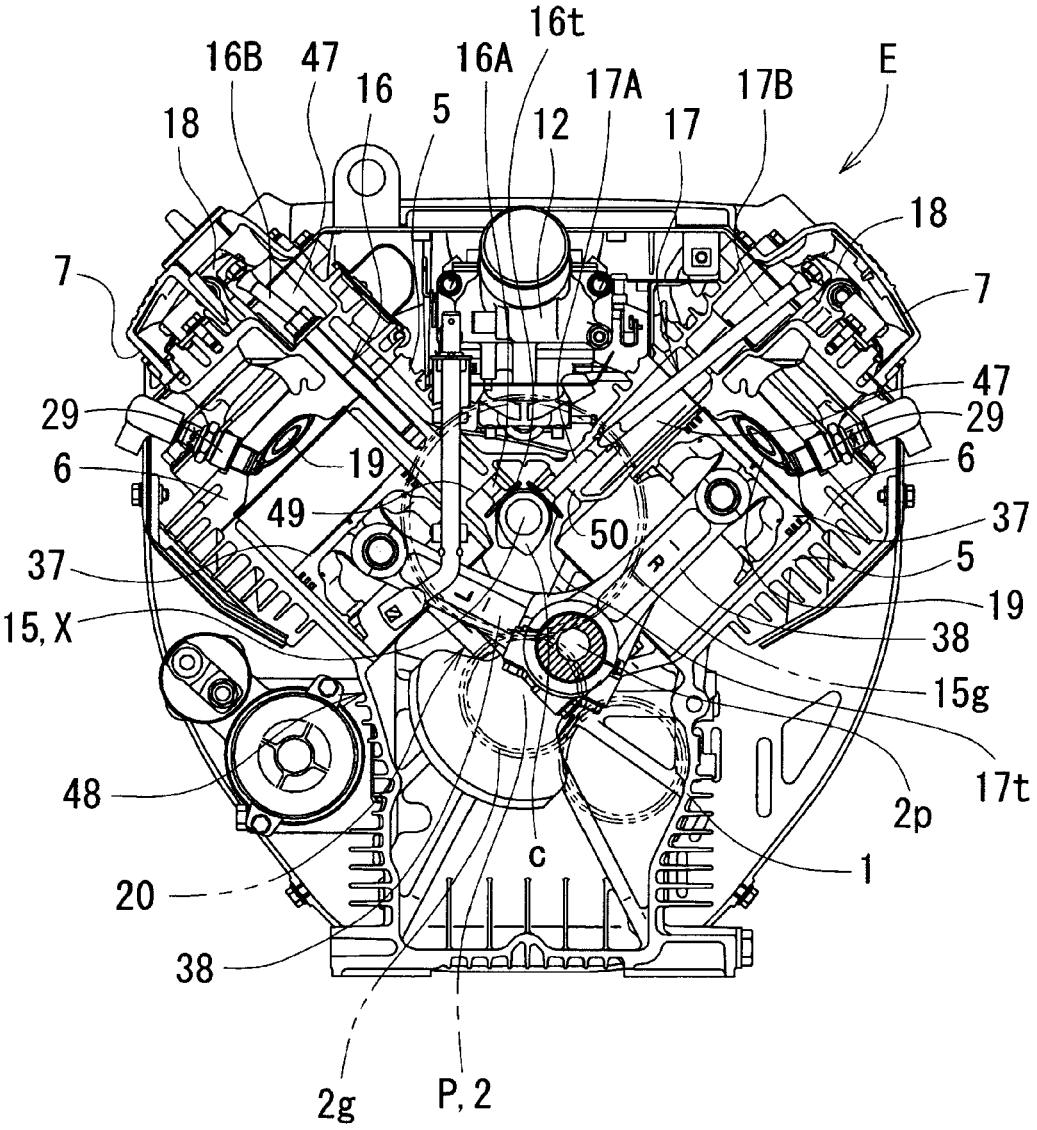
FIG. 9 is a partially cut-away rear view illustrating a camshaft drive and a valve train of the engine illustrated in FIG. 1.

A cylinder head cooling structure using engine oil is described below. As illustrated in FIGS. 9 and 4, the engine E includes a camshaft 15 rotated by the crankshaft 2, push rods 16, 17 for intake and exhaust, respectively, driven inwardly and outwardly by the camshaft 15, rocker arms 18 swung like a balance in conjunction with inward and outward movement of the push rods 16, 17, and intake and exhaust valves 19 moved inwardly and outwardly by the rocker arms 18.

Figure 11:
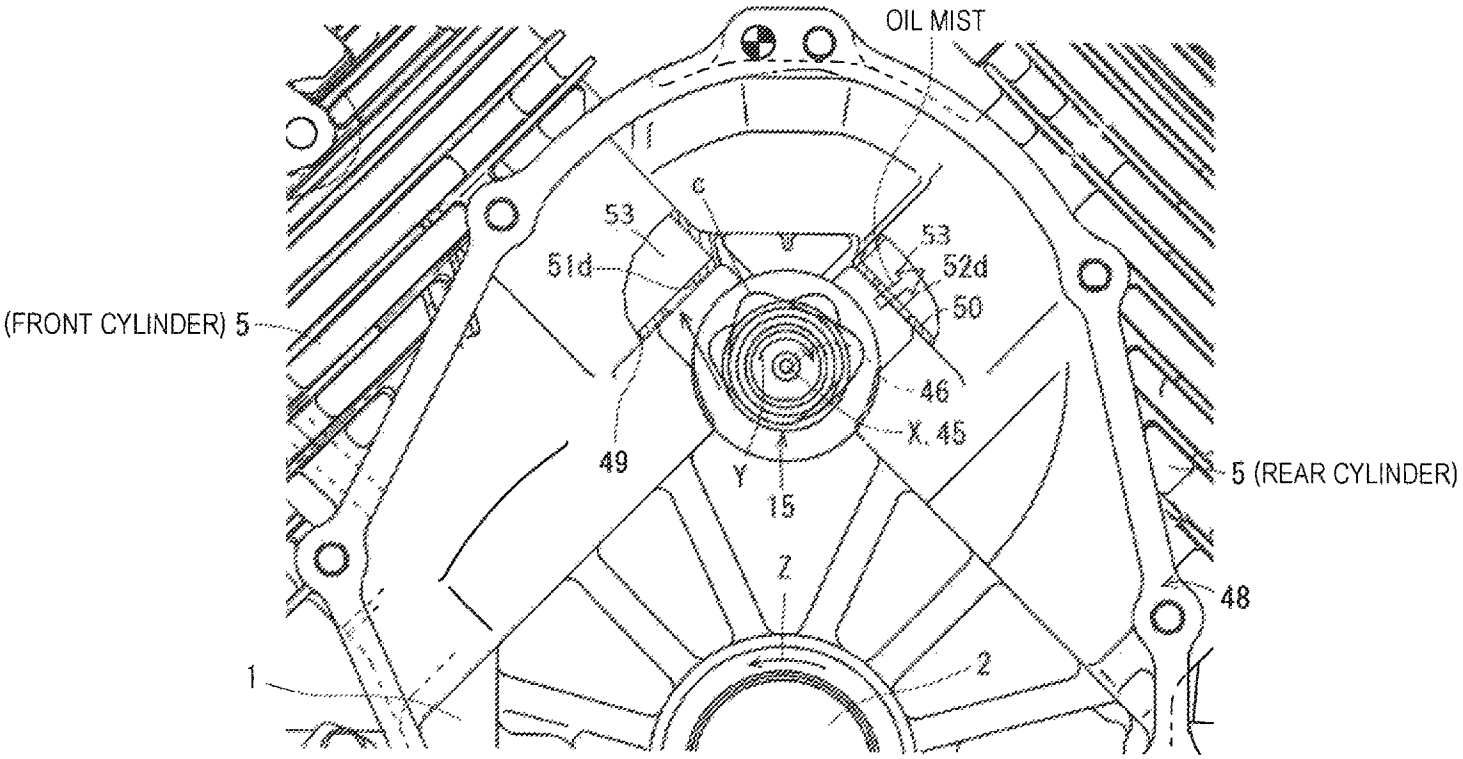
FIG. 11 is a partially cut-away rear view illustrating a camshaft portion of the engine illustrated in FIG. 1.

A gear mechanism 20 is configured such that the crankshaft 2 rotates the camshaft 15 at a speed reduction ratio of 2:1 by mating a small gear 2*g* of the crankshaft 2 with a large gear 15*g* of the camshaft 15. Reference numeral 2*p* in FIG. 9 is directed to a crank pin across a crank arm (not shown) of the crankshaft 2. The large end of a connecting rod 38 that is pin-connected to a piston 37 of each of the cylinders 5, 5 is rotatably fitted on the crank pin 2*p*. In FIG. 11, the crankshaft 2 rotates in the direction of an arrow Z, and the camshaft 15 rotates at half the rotational speed of the crankshaft 2 in the direction of an arrow Y.

The camshaft 15 is disposed in the front-rear direction between the pair of cylinders 5, 5 and immediately above the crankshaft 2. The push rods 16, 17 are configured to have lower rods 16A, 17A that are provided with tappets 16*t*, 17*t*, respectively, at lower ends and are slidably supported in the cylinders 5 and upper rods 16B, 17B that are interposed between the lower rods 16A, 17A and the rocker arms 18 and move together with the lower rods 16A, 17A, respectively. An axial center X of the camshaft 15 and the axial center P of the crankshaft 2 are parallel to each other.

Figure 10A:
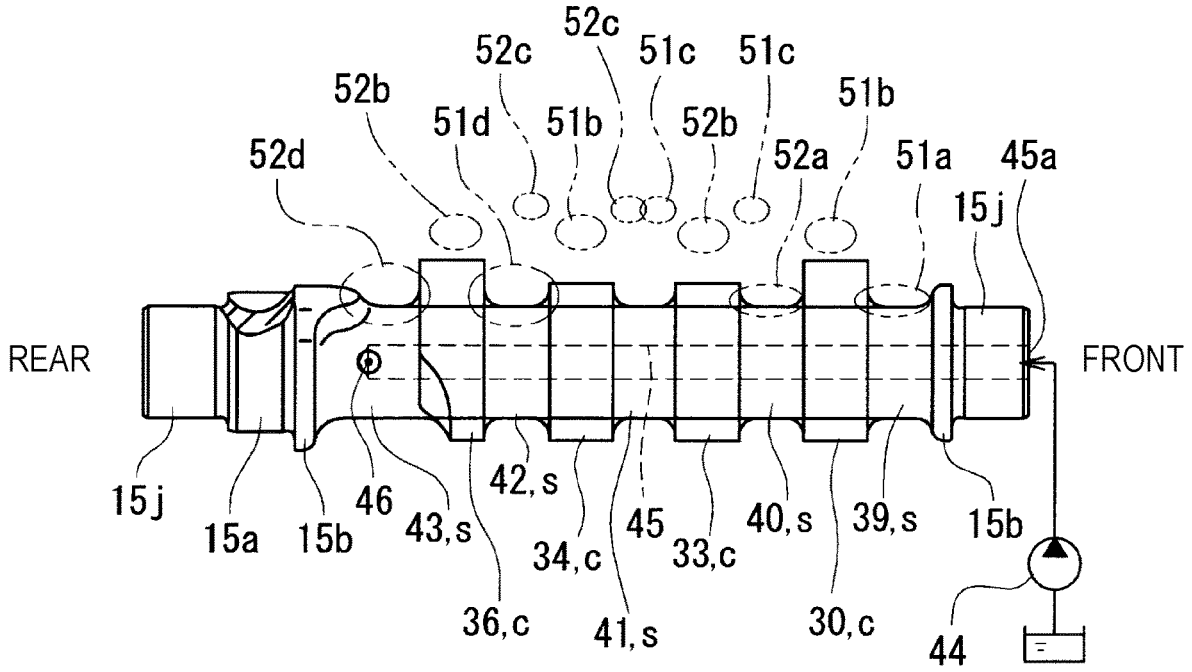
FIG. 10A is a side view illustrating a camshaft.

As illustrated in FIGS. 4 and 10A, the camshaft 15 has a total of four cams c, namely, first and second intake cams 30, 33 and first and second exhaust cams 34, 36. That is, the four cams c (30, 33, 34, 36) are used for the intake and exhaust push rods 16 for the front cylinder 5 and for the intake and exhaust push rods 17 for the rear cylinder 5, corresponding to two set of the intake and exhaust rocker arms 18, 18 of the pair of cylinder heads 6, 6.

The camshaft 15 also has journals 15*j*, 15*j* at both ends that are inserted into and supported by bearings (not shown) mounted in the cylinders 5, a gear support 15*a* for connecting the gear 15*g* by key, flanges 15*b*, 15*b* at both ends, and five shaft portions s (39, 40, 41, 42, 43). A first shaft portion 39 is a shaft portion s that is located adjacent to the front journal 15*j* through the front flange 15*b* and to a first intake cam 30. A second shaft portion 40 is a shaft portion s between the first intake cam 30 and a second intake cam 33, and a third shaft portion 41 is a shaft portion s between the second intake cam 33 and a first exhaust cam 34. A fourth shaft portion 42 is a shaft portion s between the first exhaust cam 34 and a second exhaust cam 36, and a fifth shaft portion 43 is a shift portion s that is located adjacent to the rear journal 15*j* through the rear flange 15*b* and to the second exhaust cam 36.

Figure 10B:
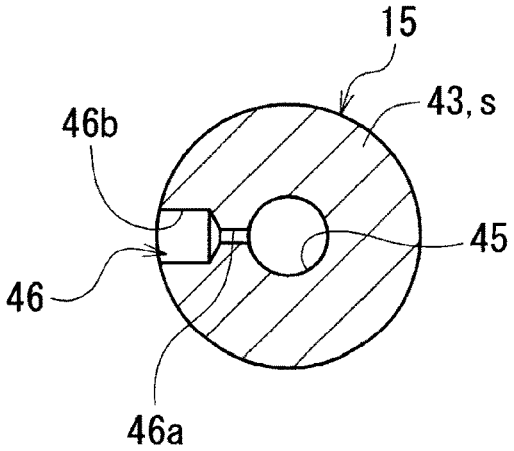
FIG. 10B is a cross-sectional view of the camshaft taken through an injection hole.

As illustrated in FIGS. 10A and 10B, the camshaft 15 has a blind internal oil passage 45 that is provided with an opening 45*a* at its front end and extends in the direction of the axial center X, and the opening 45*a* is supplied with pressurized oil discharged from an oil pump 44. The fifth shaft portion 43 of the camshaft 15 has an injection hole 46 that extends in a direction perpendicular to (i.e., an exemplary direction intersecting with) the axial center X of the camshaft 15 and communicates with the internal oil passage 45. The injection hole 46 has a small diameter orifice 46*a* that is located near the center of the shaft and communicates with the internal oil passage 45 and a large diameter hole 46*b* open to a radially outward side.

Thus, the camshaft 15 has the internal oil passage 45 extending in the direction of the axial center X of the camshaft 15, the internal oil passage 45 being supplied with engine oil discharged from the oil pump 44. Also, the injection hole 46 that extends in the direction intersecting with the axial center X and communicates with the internal oil passage 45 is formed in the shaft portion s between the cams c of the camshaft 15 or between the cam c and the journal 15*j*. Accordingly, the oil injected from the injection hole 46 is allowed to reach respective pushrod chambers 47 in which the push rods 16, 17 are disposed.

As illustrated in FIGS. 10A and 11, a front pushrod chamber bottom 49 of pushrod chamber bottoms 49, 50 in a cylinder block 48 is provided with a front oil inlet 51*a*, front tappet guide holes 51*b*, and front first and second blow-by gas inlets 51*c*, 51*d* for the front cylinder 5 (i.e., cylinder 5 on the right-hand side of FIG. 6, and cylinder 5 on the left-hand side of FIG. 9) located near the engine cooling fan 4.

The other rear pushrod chamber bottom 50 is provided with a rear oil inlet 52*a*, rear tappet guide holes 52*b*, and rear first and second blow-by gas inlets 52*c*, 52*d* for the rear cylinder 5 (i.e., cylinder 5 on the left-hand side of FIG. 6, and cylinder 5 on the right-hand side of FIG. 9) located far from the engine cooling fan 4.

The front and rear oil inlets 51*a*, 52*a*, front and rear tappet guide holes 51*b*, 52*b*, front and rear first and second blow-by gas inlets 51*c*, 52*c*, 51*d*, 52*d*, which are open to a communication hole 53, 53 (See FIG. 11) between a total of four intake and exhaust pushrod chambers 47 and/or the pair of pushrod chambers 47, 47, provide passages through which oil mist and blow-by gas in the crankcase 1 enter the cylinder head 6 and cylinder head cover 7. Although not illustrated, the push rods 16, 17 are inserted into the tappet guide holes 51*b*, 52*b*, respectively.

As illustrated in FIG. 10A, the injection hole 46 of the camshaft 15 is located in the front-rear direction opposite to the second blow-by gas inlet 52*d* of the rear cylinder 5. Thus, engine oil is injected radially from the injection hole 46 as oil jet by rotation of the camshaft 15. The oil jet is mainly introduced into the pushrod chamber 47 through the rear second blow-by gas inlet 52*d* of the rear pushrod chamber bottom 50 and is easily supplied into the cylinder head cover 7 of the rear cylinder 5 and in particular into the rocker arm 18 and the exhaust valve 19 (see FIG. 9). That is, the oil injected the injection hole 46 is allowed to reach the respective pushrod chambers 47 in which the push rods 16, 17 are disposed.

Therefore, the exhaust valve 19 (see FIG. 9) under the harshest of thermal conditions in the cylinder head 6 of the rear cylinder 5 located downstream in the rotation direction of the engine cooling fan 4 and far from the engine cooling fan 4 is supplied with oil mist through the injection hole 46 as well as oil mist in the crankcase 1, and thus oil cooling performance is significantly improved. A stem seal (not shown) of the exhaust valve 19 provides an oil reservoir, and sufficient oil is supplied.

As a result, the prior art problem that the stem seal of the exhaust valve 19 (see FIG. 9) of the rear cylinder 5 under severe temperature conditions is susceptible to degradation by heat is improved or solved by a simple modification, such as providing the camshaft with the injection hole 46, thereby improving durability inexpensively.

While a part of the oil mist from the injection hole 46 is also introduced into the rear tappet guide holes 52*b* and the front second blow-by gas inlet 51*d*, most of the oil mist supplied per unit time flows into the rear second blow-by gas inlet 52*d*. In other words, the oil from the injection hole 46 reaches at least the exhaust pushrod chamber 47 of the intake and exhaust pushrod chambers 47. It can be configured such that the fourth shaft portion 42 is provided with an open injection hole, such as the injection hole 46, so that the open injection hole faces the second blow-by as inlet 51*d* of the front pushrod chamber bottom 49, and oil supply to the exhaust valve 19 (see FIG. 9) of the front cylinder 5 per unit time is also increased.

In the cylinder head cooling structure according, to the present invention, the injection hole 46 is provided in the shaft portion s adjacent to the exhaust cam 36 for the cylinder 5 located far from the engine cooling fan 4 in the direction of the axial center P of the crankshaft 2 and/or for the cylinder 5 located upstream in the rotation direction of the engine cooling fan 4. Thus, the injection hole 46 is provided in the shaft portion s adjacent to the exhaust cam 36 for the cylinder 5 located far from the engine cooling fan 4 and to the journal 15*j*.

The shaft portions s in the camshaft 15 has a bare metal finish (i.e., not machined) produced by casting or forging, which also has a practical advantage in that the injection hole 46 can be provided inexpensively and easily as compared to providing the injection hole 46 in a machining part, such as the journal 15*j* or the cam c.

The cylinder head cooling structure according to the present invention has the following features.

At least the exhaust pushrod chamber 47 of the intake and exhaust pushrod chambers 47 is used as the pushrod chamber 47 into which the oil from the injection hole 46 is introduced.

Accordingly, more injection oil is supplied to the pushrod chamber on the exhaust side under severe thermal conditions compared to the intake side, thereby providing an additional advantage in that necessary and sufficient amount of oil is reasonably supplied.

The engine E is an air-cooled V-type engine that includes the crankcase 1, the engine cooling fan 4 mounted on one end of the crankshaft 2, the fan case 3 for housing the engine cooling fan 4, the cylinders 5, 5 extending in a V-shape from the crankcase 1 when viewed in the direction of the axial center P of the crankshaft 2, and the cylinder heads 6, 6 attached to the distill ends of the cylinders 5, 5, respectively.

The injection hole 46 is provided in the shaft portion s adjacent to the exhaust cams 36 for the cylinder 5 located far from the engine cooling fan 4 in the direction of the axial center P and/or for the cylinder 5 located upstream in the rotation direction of the engine cooling fan 4.

Accordingly, oil cooling effect is advantageously enhanced by supplying a cylinder head on the side difficult to be air-cooled of an air-cooled V-type engine with engine oil.

That is, in the air-cooled V-type engine, a cylinder located far from the engine cooling fan in the axial direction of the crankshaft and a cylinder located upstream in the rotation direction of the engine cooling fan are subjected to more severe thermal conditions than a cylinder located near the engine cooling fan in the axial direction and a cylinder located downstream in the rotation direction of the engine cooling fan.

Thus, providing the injection hole in the shaft portion adjacent to the exhaust cam for the cylinder located far from the engine cooling fan and the cylinder located upstream in the rotation direction of the engine cooling fan can increase the amount of oil that reaches the cylinder head under severe thermal conditions through the inside of the engine, such as the pushrod chamber.

The exhaust outlet 31 of the cylinder head 6 is provided on the opposite side of the engine cooling fan 4 in the direction of the axial center P, and the cylinder 5 located upstream in rotation direction Z of the engine cooling fan 4 is located farther from the engine cooling fan 4 in the direction of the axial center P than the cylinder 5 located downstream. The injection hole 46 is provided in the shaft portion s adjacent to the exhaust cam 36 for the cylinder 5 located far from the engine cooling fan 4 and to the journal 15*j*.

This configuration can have an efficient oil cooling effect on the cylinder head under most severe thermal conditions that is located far from the engine cooling fan in the axial direction of the crankshaft and upstream in the rotation direction of the engine cooling fan.

The camshaft 15, being rotated through the crankshaft 2 and the gear mechanism 20, is mounted in the cylinder block 48.

Accordingly, the cylinder head cooling structure according to the present invention is suitable for a structure in which the camshaft is rotated by the crankshaft through the gear mechanism, i.e., for an OHV engine, and the natural cooling effect of, oil mist in the crankcase can be enhanced by the oil injected from the injection hole. As a result, the cylinder head cooling structure can be provided that is suitable for an OHV structure to eliminate or solve thermal problems.

What is claimed is:

1. A cylinder head cooling structure of an engine comprising:

a camshaft rotated by a crankshaft;

a push rod driven inwardly and outwardly by the camshaft; and a rocker arm swung in conjunction with inward and outward movement of the push rod, wherein an injection hole for injecting oil pressurized by an oil pump is formed in a shaft portion between adjacent cams on the camshaft or in a shaft portion between a cam and an adjacent journal, so as to extend in a direction perpendicular to an axial center of the camshaft, a pushrod chamber bottom disposed above the camshaft so as to partition a pushrod chamber in which the push rod is disposed and a portion in which the camshaft is disposed is provided with a blow-by gas inlet and a tappet guide hole into which the push rod is inserted, the injection hole is located in a direction of the axial center of the camshaft opposite the blow-by gas inlet, and the oil injected from the injection hole is allowed to reach the pushrod chamber disposed above the blow-by gas inlet, from the blow-by gas inlet.

2. The cylinder head cooling structure according to claim 1, wherein the oil from the injection hole reaches at least an exhaust pushrod chamber of intake and exhaust pushrod chambers.

3. The cylinder head cooling structure according to claim 2, wherein the engine is an air-cooled V-type engine comprising a crankcase, an engine cooling fan mounted on one end of the crankshaft, a fan case for housing the engine cooling fan, cylinders projecting to form a V-shape from the crankcase when viewed in an axial direction of the crankshaft, and cylinder heads attached to distal ends of the cylinders, and the injection hole is provided in a shaft portion adjacent to an exhaust cam for a cylinder located far from the engine cooling fan in the axial direction and/or for a cylinder located upstream in a rotation direction of the engine cooling fan.

4. The cylinder head cooling structure according to claim 2, wherein the camshaft, being rotated through the crankshaft and a gear mechanism, is mounted in a cylinder block.

5. The cylinder head cooling structure according to claim 3, wherein an exhaust outlet of the cylinder head is provided on the opposite side of the engine cooling fan in the axial direction and the cylinder located upstream in the rotation direction of the engine cooling fan is located farther from the engine cooling fan in the axial direction than a cylinder located downstream, and the injection hole is provided in the shaft portion adjacent to the exhaust cam for the cylinder located far from the engine cooling fan and to the journal.

6. The cylinder head cooling structure according to claim 3, wherein the camshaft, being rotated through the crankshaft and a gear mechanism, is mounted in a cylinder block.

7. The cylinder head cooling structure according to claim 5, wherein the camshaft, being rotated through the crankshaft and a gear mechanism, is mounted in a cylinder block.

8. The cylinder head cooling structure according to claim 1, wherein the camshaft, being rotated through the crankshaft and a gear mechanism, is mounted in a cylinder block.

9. The cylinder head cooling structure according to claim 1, wherein the oil injected from the injection hole is injected radially as an oil jet due to rotation of the camshaft.

* * * * *